US008026436B2

(12) United States Patent
Hufford

(10) Patent No.: US 8,026,436 B2
(45) Date of Patent: Sep. 27, 2011

(54) METHOD AND APPARATUS FOR PRODUCING AUDIO TRACKS

(75) Inventor: Geoffrey C. Hufford, Cedarburg, WI (US)

(73) Assignee: SmartSound Software, Inc., Northridge, CA (US)

( * ) Notice: Subject to any disclaimer, the term of this patent is extended or adjusted under 35 U.S.C. 154(b) by 147 days.

(21) Appl. No.: 12/386,071

(22) Filed: Apr. 13, 2009

(65) Prior Publication Data

US 2010/0257994 A1 Oct. 14, 2010

(51) Int. Cl.
*G10H 1/00* (2006.01)

(52) U.S. Cl. ..... 84/609; 84/649; 84/600

(58) Field of Classification Search ..... 84/600–602, 84/609, 645, 649

See application file for complete search history.

(56) References Cited

U.S. PATENT DOCUMENTS 4,569,026 A * 2/1986 Best ..... 715/716
5,300,725 A 4/1994 Manabe
5,598,352 A * 1/1997 Rosenau et al. ..... 715/203
5,603,016 A * 2/1997 Davies ..... 713/400
5,693,902 A 12/1997 Hufford et al.
5,877,445 A 3/1999 Hufford et al.
5,895,876 A 4/1999 Moriyama et al.
5,918,303 A 6/1999 Yamaura et al.
5,952,598 A 9/1999 Goede
5,969,716 A * 10/1999 Davis et al. ..... 715/726
6,072,480 A * 6/2000 Gorbet et al. ..... 715/730
6,084,169 A * 7/2000 Hasegawa et al. ..... 84/600
6,201,176 B1 3/2001 Yourlo
6,232,539 B1 5/2001 Looney et al.
6,243,725 B1 6/2001 Hempleman et al.
6,248,946 B1 6/2001 Dwek
6,392,133 B1 * 5/2002 Georges ..... 84/609
6,448,484 B1 9/2002 Higgins
6,452,083 B2 9/2002 Pachet et al.
6,489,969 B1 * 12/2002 Garmon et al. ..... 715/723
6,528,715 B1 3/2003 Gargi
6,608,249 B2 * 8/2003 Georges ..... 84/609
6,635,816 B2 * 10/2003 Funaki ..... 84/477 R
6,686,970 B1 2/2004 Windle
6,756,533 B2 * 6/2004 Aoki ..... 84/609
6,856,997 B2 * 2/2005 Lee et al. ..... 1/1
7,012,650 B2 * 3/2006 Hu et al. ..... 348/515
7,071,402 B2 * 7/2006 Georges ..... 84/609
7,078,607 B2 7/2006 Alferness
7,165,219 B1 * 1/2007 Peters et al. ..... 715/716
7,301,092 B1 * 11/2007 McNally et al. ..... 84/612
7,394,011 B2 7/2008 Huffman
7,500,176 B2 * 3/2009 Thomson et al. ..... 715/202

(Continued)

*Primary Examiner* — David S. Warren
(74) *Attorney, Agent, or Firm* — Arthur Freilich

(57) ABSTRACT

A system for automatically manipulating prerecorded audio data to produce an audio track synchronized to a target video track. The system allows a user to select a music source from multiple music sources stored in a music library. Each music source includes multiple audio portions having block data and beat data associated therewith. The block data includes data blocks respectively, specifying the duration of the associated audio portions. Each data block preferably also includes interblock compatibility data and/or suitability data. The beat data, generally referred to as a "beatmap", comprises timing information specifying the rhythmic pulse, or "beat" for the associated music source portion. The system is operable to produce an audio track synchronized to a video timing specification (VTS) specifying successive timing segments delimited by successive video events. After the user selects a music source, the system generates a music segment for each defined timing segment. Each music segment is generated by assembling an ordered sequence of compatible data blocks selected at least in part based on their suitability and/or compatibility characteristics.

11 Claims, 10 Drawing Sheets

U.S. PATENT DOCUMENTS

| | | | | |
|---|---|---|---|---|
| 7,735,011 | B2 * | 6/2010 | Najdenovski | 715/716 |
| 7,754,959 | B2 * | 7/2010 | Herberger et al. | 84/626 |
| 2002/0059074 | A1 * | 5/2002 | Bhadkamkar et al. | 704/500 |
| 2002/0062313 | A1 * | 5/2002 | Lee et al. | 707/3 |
| 2002/0134219 | A1 * | 9/2002 | Aoki | 84/609 |
| 2002/0170415 | A1 * | 11/2002 | Hruska et al. | 84/609 |
| 2003/0160944 | A1 * | 8/2003 | Foote et al. | 352/1 |
| 2004/0027369 | A1 * | 2/2004 | Kellock et al. | 345/716 |
| 2004/0031379 | A1 * | 2/2004 | Georges | 84/625 |
| 2005/0217462 | A1 * | 10/2005 | Thomson et al. | 84/612 |
| 2006/0050140 | A1 * | 3/2006 | Shin et al. | 348/14.02 |
| 2006/0056806 | A1 * | 3/2006 | Terakado et al. | 386/69 |
| 2006/0092487 | A1 * | 5/2006 | Kuwabara et al. | 358/537 |
| 2006/0101339 | A1 * | 5/2006 | Katsumata | 715/730 |
| 2006/0112810 | A1 * | 6/2006 | Eves et al. | 84/609 |
| 2006/0122842 | A1 * | 6/2006 | Herberger et al. | 704/278 |
| 2006/0259862 | A1 * | 11/2006 | Adams et al. | 715/716 |
| 2007/0044643 | A1 | 3/2007 | Huffman | |
| 2007/0101355 | A1 * | 5/2007 | Chung et al. | 725/18 |
| 2007/0137463 | A1 * | 6/2007 | Lumsden | 84/603 |
| 2007/0162855 | A1 * | 7/2007 | Hawk et al. | 715/730 |
| 2007/0189710 | A1 * | 8/2007 | Pedlow | 386/54 |
| 2007/0209499 | A1 * | 9/2007 | Kotani | 84/644 |
| 2007/0230911 | A1 * | 10/2007 | Terasaki | 386/96 |
| 2008/0190268 | A1 * | 8/2008 | McNally | 84/609 |
| 2008/0195981 | A1 * | 8/2008 | Pulier et al. | 715/974 |
| 2008/0232697 | A1 * | 9/2008 | Chen et al. | 382/225 |
| 2008/0247458 | A1 * | 10/2008 | Sun et al. | 375/240.01 |
| 2008/0304573 | A1 * | 12/2008 | Moss et al. | 375/240.28 |
| 2008/0309795 | A1 * | 12/2008 | Mitsuhashi et al. | 348/231.99 |
| 2009/0046991 | A1 * | 2/2009 | Miyajima et al. | 386/95 |
| 2009/0049371 | A1 * | 2/2009 | Keng | 715/202 |
| 2009/0049979 | A1 * | 2/2009 | Naik et al. | 84/636 |
| 2009/0097823 | A1 * | 4/2009 | Bhadkamkar et al. | 386/96 |
| 2009/0162822 | A1 * | 6/2009 | Strachan et al. | 434/309 |
| 2009/0209237 | A1 * | 8/2009 | Six | 455/414.1 |
| 2010/0023485 | A1 * | 1/2010 | Cheng Chu | 707/3 |
| 2010/0040349 | A1 * | 2/2010 | Landy | 386/96 |
| 2010/0070057 | A1 * | 3/2010 | Sugiyama | 700/94 |
| 2010/0145794 | A1 * | 6/2010 | Barger et al. | 705/14.45 |
| 2010/0162344 | A1 * | 6/2010 | Casagrande et al. | 725/137 |
| 2010/0172591 | A1 * | 7/2010 | Ishikawa | 382/224 |
| 2010/0183280 | A1 * | 7/2010 | Beauregard et al. | 386/54 |
| 2010/0198380 | A1 * | 8/2010 | Peiffer et al. | 700/94 |
| 2010/0257994 | A1 * | 10/2010 | Hufford | 84/609 |

* cited by examiner

| Block Name | Start | End | Compatibility | Suitability |
|---|---|---|---|---|
| A | 00:00.0 | 00:18.6 | B, F | begin, event |
| B | 00:18.6 | 00:32.3 | A, C, E, H | event |
| C | 00:32.3 | 00:44.8 | A, C, D, F | |
| D | 00:44.8 | 01:07.4 | B, E, H | |
| E | 01:07.4 | 01:22.6 | D, F, G | event |
| F | 01:22.6 | 01:44.8 | G | |
| G | 01:44.8 | 02:02.5 | B, D, G, H | event |
| H | 02:02.5 | 02:22.7 | none | end |

| Beat index | Beat Time (seconds) | Downbeat |
|---|---|---|
| Beat 0 | 00:00.0 | X |
| Beat 1 | 00:00.8 | |
| ... | | |
| Beat 12 | 00:18.6 | X |
| Beat 13 | 00:19.8 | |
| Beat 14 | 00:20.9 | |
| Beat 15 | 00:22.1 | |
| Beat 16 | 00:23.6 | |
| Beat 17 | 00:24.9 | X |
| Beat 18 | 00:26.4 | |
| ... | | |
| Beat n | ?? | ?? |

| VTS Index | Event Time | Event Title (optional) |
|---|---|---|
| T1 | 00:00:00:00 | Music Start |
| T2 | 00:00:35:00 | Scene change |
| T3 | 00:00:57:00 | Scene change |
| T4 | 00:01:31:00 | Music End |

Fig. 7A

| Timing segment | Start | End | Duration | Begin | Target |
|---|---|---|---|---|---|
| S1 | 00:00.0 | 00:35.0 | 0:35.0 | start | |
| S2 | 00:35.0 | 00:57.0 | 0:22.0 | | |
| S3 | 00:57.0 | 01:31.0 | 0:34.0 | | end |

Fig. 7B

| Timing segment | Start | End | Duration | Begin | Target |
|---|---|---|---|---|---|
| S1 | 00:00.0 | 00:35.0 | 0:35.0 | start | G |
| S2 | 00:35.0 | 00:57.0 | 0:22.0 | G | B |
| S3 | 00:57.0 | 01:31.0 | 0:34.0 | B | end |

Fig. 7C

METHOD AND APPARATUS FOR PRODUCING AUDIO TRACKS

FIELD OF THE INVENTION

This invention relates generally to hardware/software systems for creating an audio track synchronized to a specified, i.e., target video track.

BACKGROUND OF THE INVENTION

A "video track", as used herein, refers to an ordered sequence of visual events represented by any time based visual media, where each such event (hereinafter, "video" event) can be specified by a timing offset from a video start time. A video event can constitute any moment deemed to be visually significant.

An "audio track", as used herein, refers to an ordered sequence of audible events represented by any time based audible media, where each such event (hereinafter, "audio" event) can be specified by a timing offset from an audio start time. A audio event can constitute any moment deemed to be audibly significant.

It is often desirable to produce an audio track, e.g., music, to accompany a video track, e.g., a TV commercial or full length film. When bringing video and audio together, the significant events in the respective tracks must be well synchronized to achieve a satisfactory result.

When composing original music specifically for a video track, it is common practice to compile a list of timing offsets associated with important video events and for the composer to use the list to create music containing correspondingly offset music events. Composing original music to accompany a video is quite costly and time consuming and so it has become quite common to instead manipulate preexisting, i.e., prerecorded, music to synchronize with a video track. The selection of appropriate prerecorded music is a critical step in the overall success of joining video and audio tracks. The genre, tempo, rhythmic character and many other musical characteristics are important when selecting music. But, beyond the initial selection, the difficulty of using prerecorded music is that its audio/music events will rarely align with the video events in the video track. Accordingly, a skilled human music editor is typically employed to select suitable music for the video and he/she then uses a computer/workstation to edit the prerecorded music. Such editing typically involves interactively shifting music events in time generally by removing selected music portions to cause desired music events to occur sooner or by adding music portions to cause desired music events to occur later. Multiple iterative edits may be required to alter the prerecorded music to sufficiently synchronize it to the video track and great skill and care is required to ensure that the music remains aesthetically pleasing to a listener. Various software applications (e.g., Avid Pro Tools, Apple Soundtrack, SmartSound Sonicfire Pro, Sony Vegas, Sync Audio Studios Musicbed) have been released to facilitate the editing of prerecorded music. Such applications generally provide a user interface offering the user a means to visualize the timing relationship between a video track and a proposed audio track while providing tools to move or transform items in the audio tracks. The standard approach is for the editor to repeatedly listen to the source music to acquaint himself with its form while also listening for musical events that can be utilized to effectively enhance the video events in the video track. The process is largely one of trial and error, using a "razor blade" tool to cut the music into sections and subsequently slide the sections backwards or forwards to test the effectiveness of the section at that timing. Once a rough arrangement of sections is determined, additional manual trimming and auditioning of the sections is generally required to make the sections fit together in a continuous stream of music. The outlined manual process is very work intensive and requires professional skill to yield a musically acceptable soundtrack.

An alternative method utilized by a few software applications involves adjusting the duration of a musical composition or user defined sub-section by increasing or decreasing the rate (i.e., tempo, beats per minute) at which the media is played. If the tempo is increased/decreased a uniform amount for the entire musical composition, then it is true that the timing for which a single musical event occurs can be adjusted relative to the beginning of the music, but it is mathematically unlikely that multiple music events will align with multiple video events via a single tempo adjustment. Additionally, only small timing adjustments are practical to avoid degrading the recording of the music.

SUMMARY OF THE INVENTION

The present invention is directed to an enhanced method and apparatus for automatically manipulating prerecorded audio data to produce an audio track synchronized to a target video track. For the sake of clarity of presentation, it will generally be assumed herein that "audio data", refers to music, but it should be understood that the invention is also applicable to other audio forms; e.g., speech, special effects, etc.

More particularly, the present invention is directed to a system which allows a user to select a music source from multiple music sources stored in a music library. Each music source includes multiple audio portions having block data and beat data associated therewith. The block data includes data blocks respectively, specifying the duration of the associated audio portions. Each block preferably also includes interblock compatibility data and/or suitability data. The beat data, generally referred to as a "beatmap", comprises timing information specifying the rhythmic pulse, or "beat" for the associated music source portion.

A system in accordance with the invention is operable by a user to produce an audio track synchronized to a video timing specification (VTS) specifying successive timing segments delimited by successive video events. After the user selects a music source, the system generates a music segment for each defined timing segment. In a preferred embodiment, for each music segment to be generated, an "untrimmed" music segment is first generated by assembling an ordered sequence of compatible data blocks selected at least in part based on their suitability and/or compatibility characteristics. The assembled data blocks forming the untrimmed music segment represent audio portions having a duration at least equal to the duration of the associated timing segment. If necessary, the untrimmed music segment is then trimmed to produce a final music segment having a duration matching the duration of the associated timing segment.

In a preferred embodiment, trimming is accomplished by truncating the audio portion represented by at least one of the data blocks in the untrimmed music segment. Preferably, audio portions are truncated to coincide with a beat defined by an associated beat map. After final music segments have been generated for all of the timing segments, they are assembled in an ordered sequence to form the audio track for the target video track.

For simplicity of explanation, reference herein will sometimes be made to trimming the duration of a data block but this should be understood to mean modifying a data block to adjust the duration of the associated audio portion.

In accordance with an optional but useful feature of a preferred embodiment of the invention, a video timing specification analyzer is provided for automatically analyzing each video timing specification to identify "best fit" music sources from the music library, i.e., sources having a tempo closely related to the timing of video events, for initial consideration by a user.

BRIEF DESCRIPTION OF THE FIGURES

FIG. 7A is a table representing an exemplary video timing specification;

FIG. 7B is a table representing exemplary timing segments calculated from the video timing specification of FIG. 7A;

FIG. 7C is a table representing the timing segments of FIG. 7B with the inclusion of block data;

DETAILED DESCRIPTION

Figure 1A:
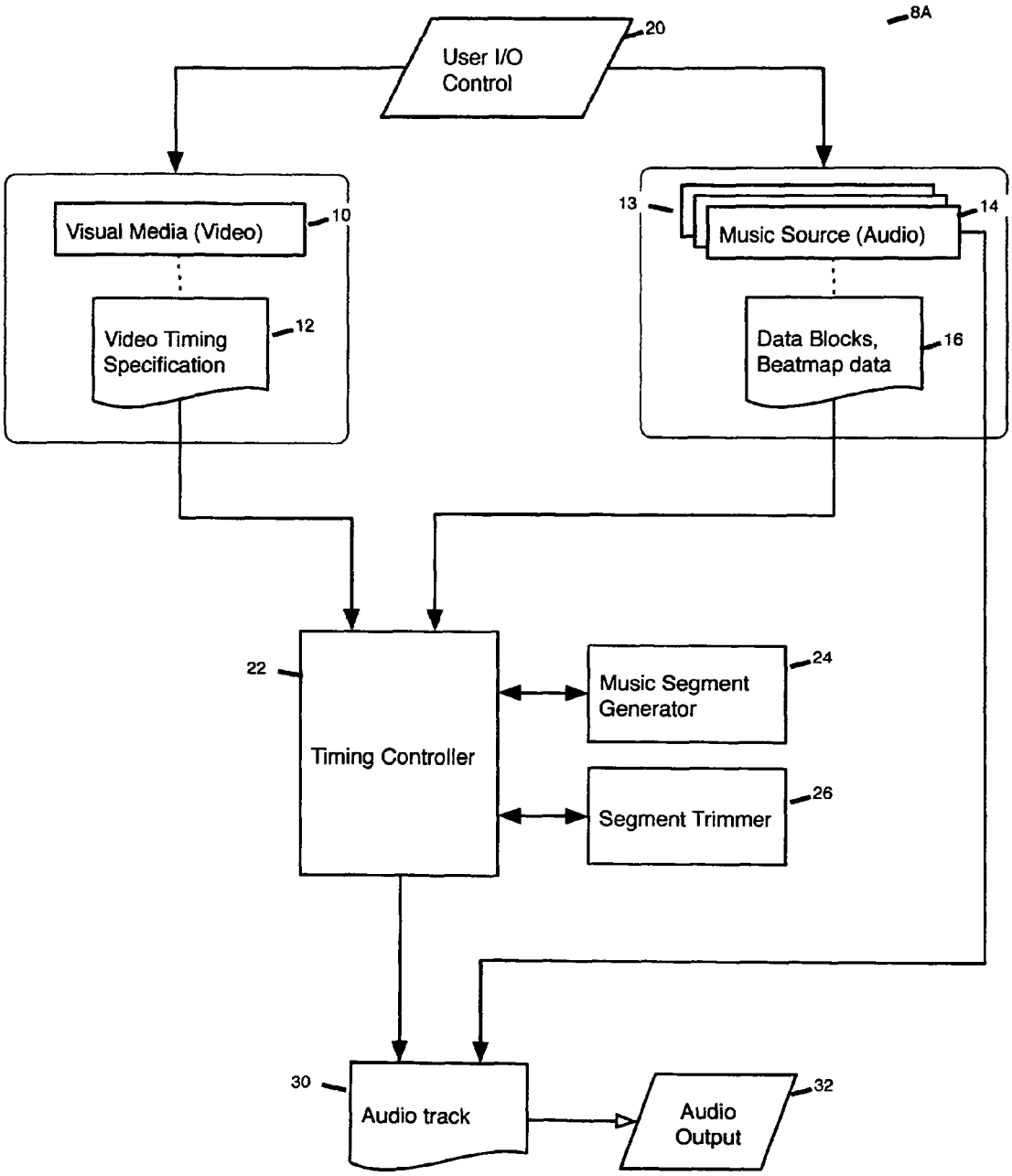
FIG. 1A is a high level block diagram of a system in accordance with the invention.

Attention is initially directed to FIG. 1A which illustrates a block diagram of a preferred system 8A in accordance with the invention for producing an audio track 30 to accompany a video track 10 having an associated video timing specification 12. The video timing specification 12 defines the timing points of significant video events, e.g., scene changes, occurring in the video track 10. The system 8A operates primarily in response to initial user inputs via I/O control 20 to automatically produce the audio track 30.

The system 8A includes a library 13 storing a plurality of prerecorded music sources 14. Each music source in accordance with the invention is comprised of multiple audio portions with each portion having a data block and beat data 16 associated therewith. Each data block (as will be discussed in greater detail in connection with FIGS. 5A, 5B) in accordance with the invention specifies the start and end times, and thus the duration, of the associated audio portion and the compatibility between portions, or data blocks. For example, an exemplary music source may have eight audio portions respectively represented by data blocks A, B, C, D, E, F, G, H. It may be musically inappropriate for the portion represented by data block B to ever immediately precede blocks D, F, or G. Accordingly, interblock compatibility data is incorporated in each data block where interblock compatibility refers to the ability of a block to sequentially lead (or alternatively sequentially follow) each other block according to aesthetic, e.g., musical criteria. As will be further mentioned hereinafter, each data block may also include additional data such as suitability data indicating whether the associated audio portion is appropriate to begin or end a music segment or especially appropriate to constitute a music event for synchronization with a video event.

A music event constitutes an audibly significant moment of a music source. It can be subjective to a particular listener but primarily falls within two types:

Stings—are typically a quick intensity burst of sound (often percussive or loud instruments added to the established texture of the music). Once the sting is completed the music will sound relatively unchanged from what it sounded like prior to the sting.

Changes—are easily heard when an established musical texture, rhythm, melody or harmony is added, removed or replaced by a new one. The change may occur quickly or transition over a period of time. In either case, a listener is aware that something in the music is now different. A common change in music involves the musical structure (form), such as moving from a verse to the chorus within a song. Listeners are able to easily detect when the form has changed, and most musical compositions are comprised of multiple sections, therefore making this kind of sectional change ideal for synchronization with events in a video.

As depicted in FIG. 1A, the video timing specification 12 and block/beat data 16 associated with a selected music source are applied to a timing controller 22 which processes the respective data to produce the audio track 30. The controller 22 operates in conjunction with a music segment generator 24 which operates, as will be discussed hereinafter (e.g., FIG. 4), to produce an untrimmed music segment comprised of an ordered sequence of data blocks for each timing segment defined between successive video events specified by the video timing specification 12. If the untrimmed music segment generated by generator 24 has a duration greater than that of the associated timing segment, its duration is trimmed by a process executed by segment trimmer 26, as will be described in detail hereinafter (e.g., FIG. 10).

Figure 1B:
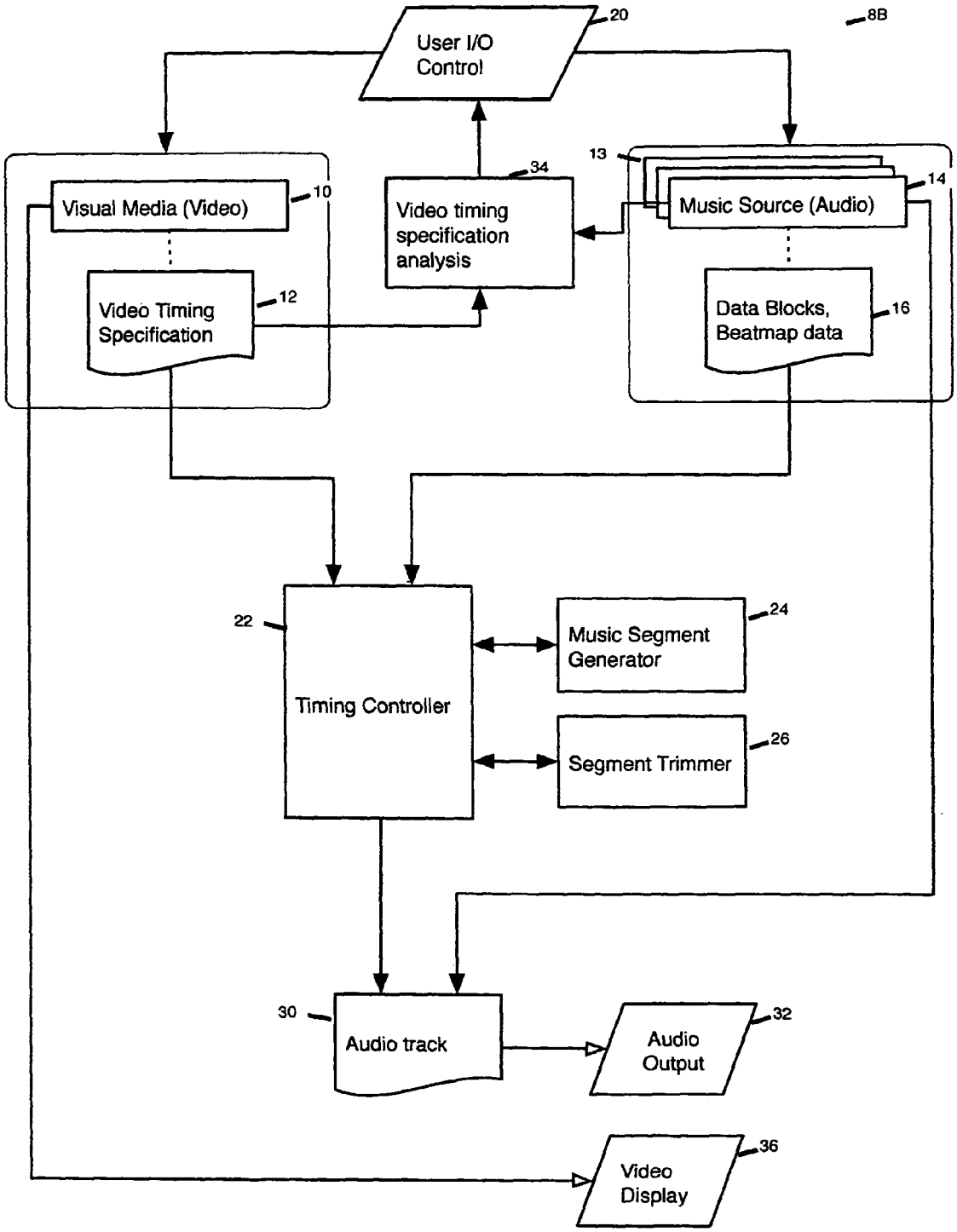
FIG. 1B is a high level block diagram of an alternative system similar to FIG. 1A, but incorporating additional functions.

FIG. 1B is substantially identical to FIG. 1A except that it shows a system 8B incorporates a video timing specification analyzer 34 to facilitate the automatic selection of an appropriate music source. More particularly, the analyzer 34 analyzes the intervals between video events, as defined by the video timing specification 12, and determines the most similarly matched music source 14. Various criteria can be used to determine matching. For example, the analyzer 34 preferably examines the video timing specification to determine a tempo which most closely matches the occurrence of video events. The analyzer 34 can then choose a particular music source of appropriate tempo or recommend one or more music sources to the user who can make a choice via I/O control 20. The use of a music source that is paced at the preferred tempo increases the probability that music events within the music source will naturally align with the video events in the video timing specification, with the beneficial result of reducing the required manipulative processing, or trimming. FIG. 1B also introduces an optional video display 36 for displaying the video, i.e., visual media, file, to the user enabling the user to simultaneously view the video and synchronized audio output.

Figure 2:
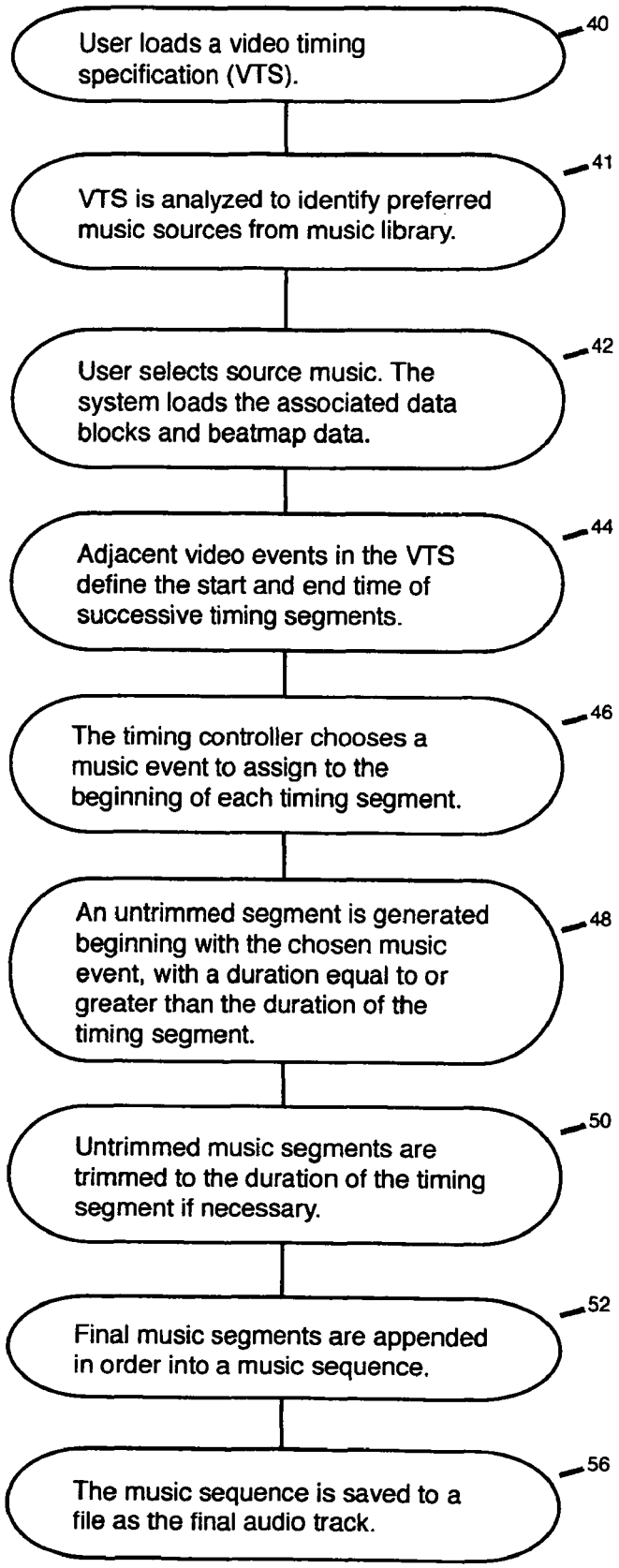
FIG. 2 is a flow chart depicting the operational sequence of the system of FIG. 1B.

FIG. 2 is a flow chart describing the operational sequence performed by the system 8B of FIG. 1B. More particularly, the system sequentially performs steps 40 through 56 to produce a final audio track 30.

Figure 3:
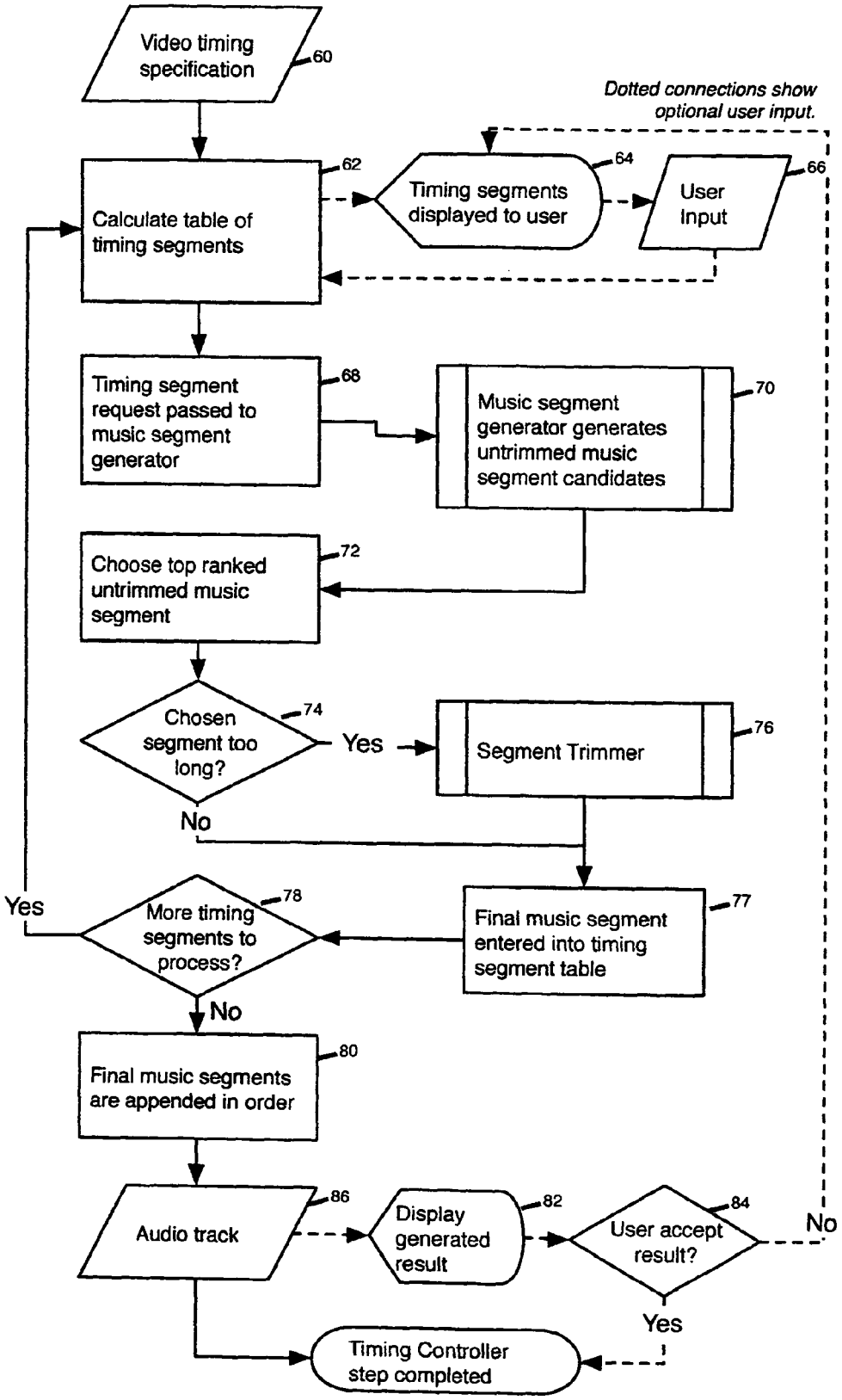
FIG. 3 is a flow chart depicting the internal operation of the system of FIG. 1B.

FIG. 3 depicts the operation of the timing controller 22 in greater detail. A video timing specification (VTS) 60 is fed into the timing controller 22. The specification 60 can be supplied from a variety of sources, and can be in various formats, e.g., a standard EDL file. The timings specified in the VTS are preferably laid out in a table (FIG. 7A) allowing successive timing segments 62 to be determined, each timing segment having a calculated start time, end time, and duration, along with music block begin and target information (FIG. 7B).

A data display 64 preferably displays the timing segments to a user and the user is able to interact with the timing segment data via input 66. In a preferred embodiment, the timing segment table can be displayed on the computer screen with the user controlling the keyboard and mouse to modify, add or remove timing segments. In an alternative embodiment, the timing segment data can be displayed and modified in a visual timeline form, presenting the user with a visualization of the relative start time and duration of each timing segment. User modifications will preferably be recalculated into the table 62 to ensure that timing segments are successive.

Figure 4:
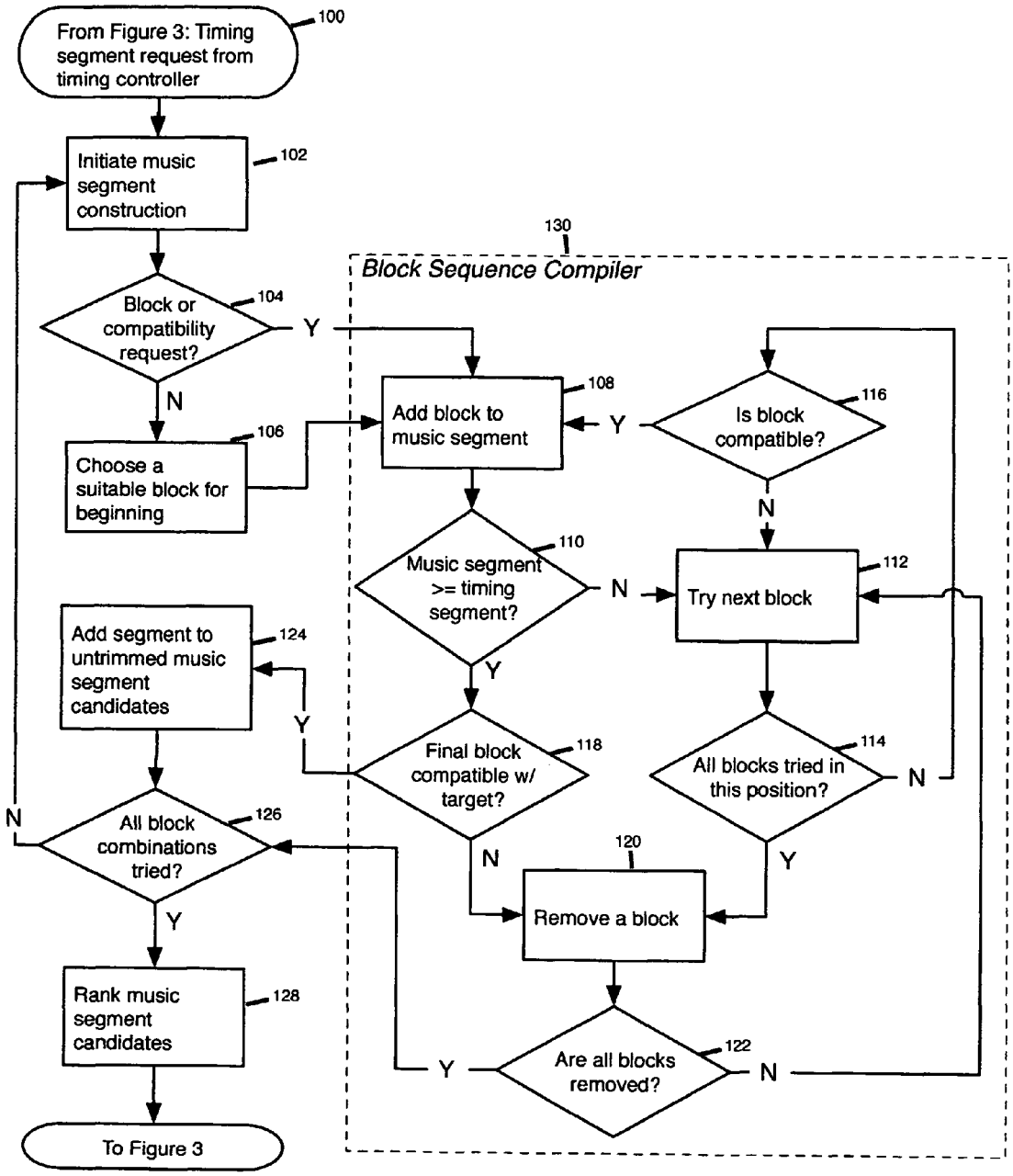
FIG. 4 is a flow chart depicting the internal operation of the music segment generator of FIG. 1B.

The first timing segment is passed in step 68 to the music segment generator 70 (MSG) (FIG. 4). The MSG 70 will generate and rank a plurality of untrimmed music segment candidates that are tailored to conform to the requested timing segment duration. Step 72 involves choosing the top ranked music segment candidate. If the chosen music segment is longer than the timing segment request 74, it will be passed to the segment trimmer 76 (FIGS. 9/10) to reduce the duration in a musically aesthetic manner. The timing segment table 62 is amended to reflect the actual duration, begin and target data for the trimmed segment. The process continues to step 78 by looping back to step 62 until untrimmed music segments have been generated for all of the timing segments in table 62. Finally, the generated music segments are appended in step 80 into a single sequence of segments as an audio track 86, suitable for audible playback through the system or capable of being saved to a storage device as an audio file. Optionally, the audio track 86 may be displayed to the user 82 and the user may be given a means 84 to evaluate the result and determine if he/she would like to make further modifications to the timing segment table by returning to step 64 to cause the generating process to restart.

FIG. 4 depicts a preferred music segment generator 70 (MSG) called by the timing controller 22 (FIGS. 1A, 1B). The MSG 70 is configured to construct music segments from music portions derived from a music source 14 (FIG. 1A, 1B). The MSG 70 is controlled by specifying the duration along with beginning and/or ending data block requests for a desired music segment. Utilizing a block sequence compiler 130, the music segment generator 70 will iterate through all possible sequence derivations of the music data blocks and return a plurality of music segments that are the closest to the specified request.

Construction of a new music segment having a duration matching a timing segment request 100 received from step 68 in FIG. 3 commences at step 102. Step 104 determines if the timing segment specifies a data block to begin the segment. If so, that data block will be added 108 to the music segment under construction. If the timing segment does not specify a data block, the final data block in the previous timing segment will be used to locate a suitable data block to begin this new music segment. If there is no previous timing segment, then a data block that is suitable to begin a musical composition is chosen at 106 and added to the music segment 108.

The duration of the music segment under construction is evaluated at 110 by summing the duration of all data blocks in the segment. As long as the music segment is shorter in duration than the requested timing segment duration, additional data blocks 112 will be tried and evaluated for their compatibility with the previous data block in the segment 116. The process continues, effectively trying and testing all combinations of data blocks until a combination is discovered that has a suitable duration 110 and is compatible with a timing segment request. If all blocks are tried and the music segment fails the compatibility or duration test 114, the final data block in the music segment is removed 120 to make room for trying other data blocks in that position. If all data blocks are removed from the music segment 122, it indicates that all combinations of data blocks have been tried and that the iterative process of the block sequence compiler 130 is complete.

A music segment that is evaluated in step 118 to successfully fulfill the timing segment request, is retained in memory in a table of segment candidates 124. The entire process is continued by creating new segments 102 until all possible combinations of data blocks have been tried 126.

The collected music segment candidates 124 will vary from one another as each music segment represents a different combination and utilization of the available music data blocks. The music segments can therefore be ranked 128 based on criteria, such as duration or data block usage. The ranked music segment candidate table is returned to the timing controller (FIG. 3, step 72).

Figures 5A, 5B:
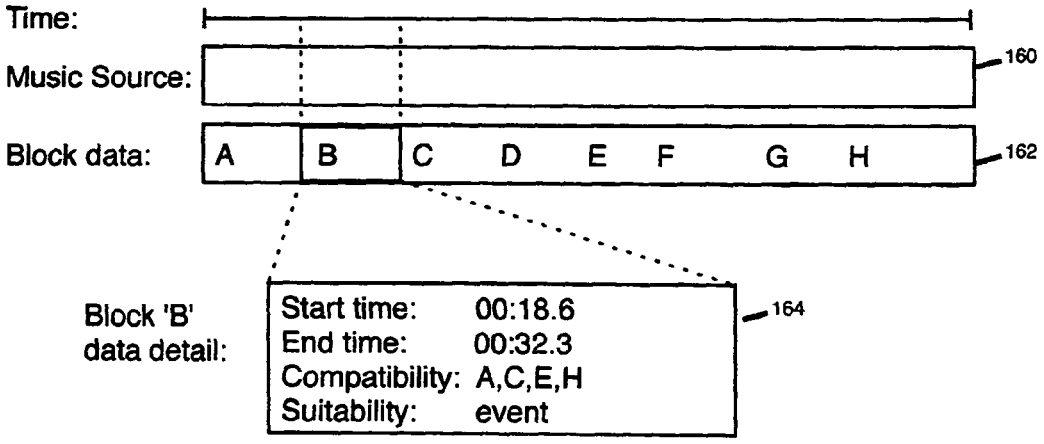
FIG. 5A is a table representing block data of an exemplary music source.
FIG. 5B is a time based depiction of the block data of FIG. 5A relative to the music source.

Attention is now directed to FIGS. 5A and 5B which schematically represent an exemplary music source 160 having multiple music portions respectively represented by data blocks (A, B, C, D, E, F, G, H) 162. FIG. 5A is a table showing for each data block its start time and its end time and also its compatibility and suitability characteristics. For example, exemplary block A is shown as having a duration of 18.6 seconds (although for simplicity herein durations are represented to a precision of only one tenth of a second it should be understood that in an actual implementation of the invention, it is preferable to use much higher precisions, e.g., 0.0001 seconds) and a compatibility characteristic indicating that it should, for reasons of music aesthetics, be followed only by data blocks B and F when constructing a music segment. The block A suitability characteristic indicates that it would be appropriate for use in a music segment to begin the segment and/or to create a music event.

Figures 6A, 6B:
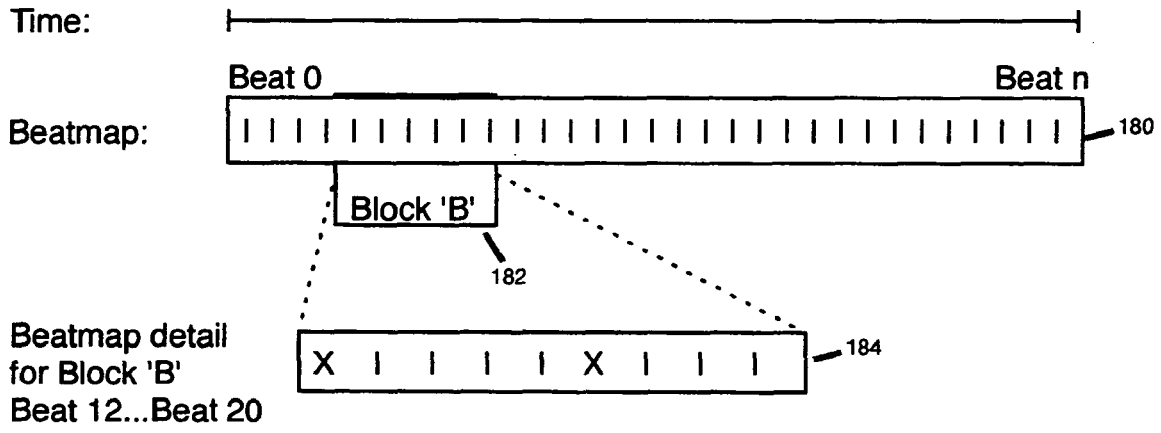
FIG. 6A is a table representing beatmap data of an exemplary music source.
FIG. 6B is a time based depiction and detail of the beatmap data of FIG. 6A.

Attention is now directed to FIGS. 6A and 6B which schematically represent exemplary beat data for a typical music source. FIG. 6A shows a beatmap table indicating the timing points of discrete beats and indicating particularly significant beats, e.g., downbeats. Note that the intreval between adjacent beats is not necessarily uniform. FIG. 6B represents the beatmap data relative to a time scale 180 and shows for exemplary block B 182 the beatmap data 184.

Attention is now directed to FIG. 7A which comprises a table showing a simplified example of exemplary video timing specification data. Note that the table identifies four distinct video events T1, T2, T3, T4 and indicates the timing occurrence for each. Additionally, the table (FIG. 7A) optionally identifies the type of each video event. FIG. 7B comprises a timing segment request table listing successive timing segments S1, S2, S3 derived from the video timing specification data (FIG. 7A). It will be recalled from the description of FIGS. 1A, 1B that the music segment generator 24 operates to populate each timing segment S1, S2, S3 with a music segment represented by a sequence of data blocks. FIG. 7C comprises a table similar to FIG. 7B but showing the beginning and ending, i.e., target, data blocks for each timing segment.

Figure 8:
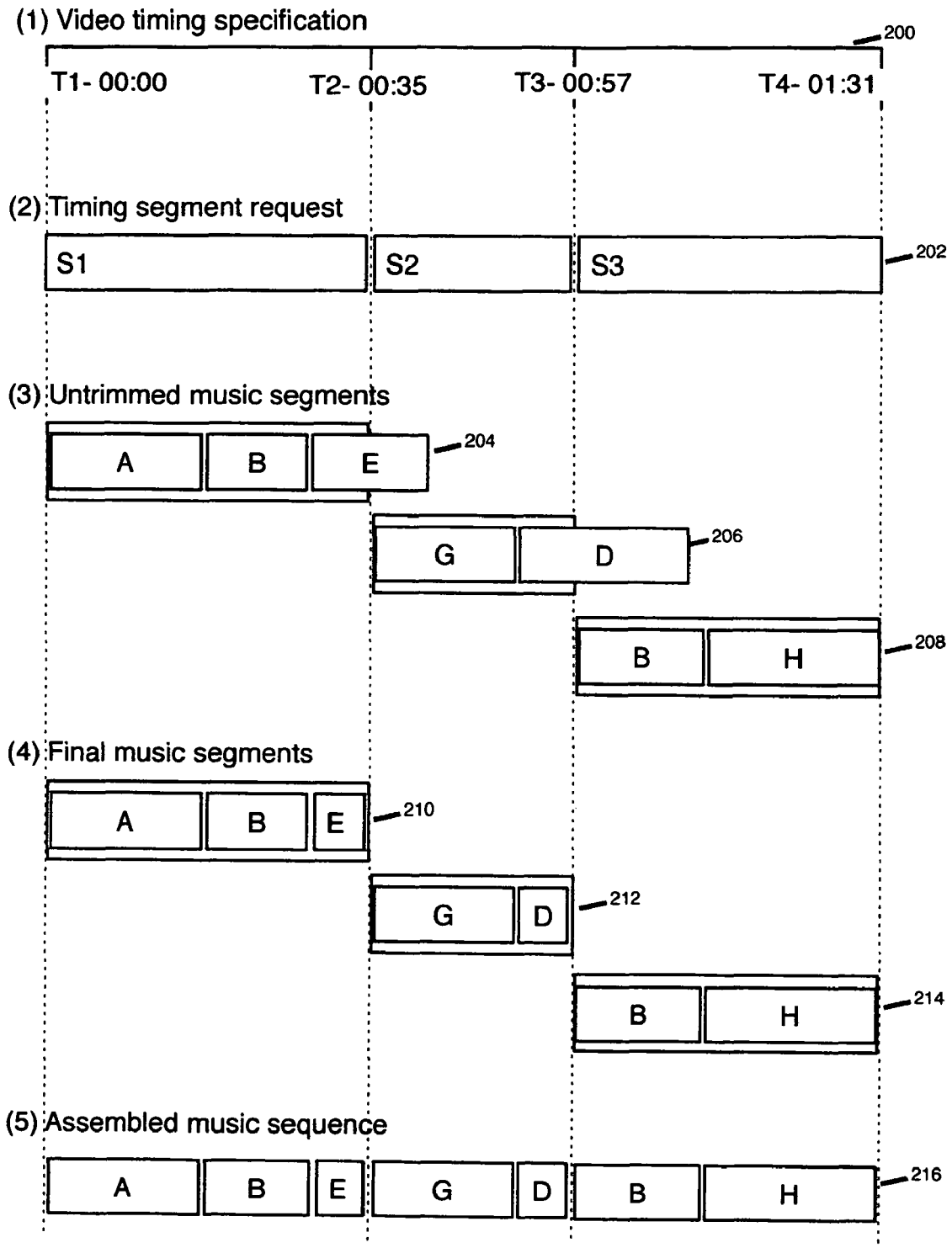
FIG. 8 is a chart depicting exemplary results at various stages in the operation of a system in accordance with the invention.

FIG. 8 depicts successive stages (1 . . . 5) performed by the timing controller of FIG. 3, to show how a video timing specification is processed starting in stage 1, to ultimately assemble multiple music sequence in stage 5.

Stage 1, depicts the exemplary data for a video timing specification (FIG. 7A) in a time based representation. The video events, T1, T2, T3, T4, are plotted along a timeline 200 with their respective event times. The objective for the timing controller is to generate a viable music soundtrack where music begins at T1, a music event occurs at T2, a second music events occurs at T3, and the music ends at T4. Stage 2 depicts three timing segments, S1, S2, S3, (FIG. 7B) derived from the video events in stage 1. Each timing segment has a start time and end time that are plotted on the timeline 202.

Stage 3 begins when the music sequence generator (MSG) 70 (FIG. 3) is called with the parameters for timing segment S1. A music segment candidate 204 comprised of data blocks A, B, E is generated by the MSG 70 and selected by the timing controller at FIG. 3/step 72 as the best fit for segment S1.

Stage 4 shows the music segment 210 after the segment trimming step 77 (FIG. 3) to conform to timing segment S1. The process continues with the generation of music segment 206 for timing segment S2. The music segment 206 is comprised of blocks G, D, chosen in part because of compatibility with ending block E of S1. The trimmed result of S2 is shown at 212. The final music segment 208 is constructed to correspond to timing segment S3 by choosing blocks B, H, block B because of its start compatibility with block D in S2, and block H because of its suitability as an end block. In this example, untrimmed music segment 208 has a duration matching timing segment S3 so trimming is not necessary to produce final music segment 214.

In stage 5, the three exemplary music segments 210, 212, 214 are connected to make a complete music sequence 216, for constructing the final audio track. In a preferred embodiment of the invention, construction of the final audio track can be enhanced by the selective application of an audio cross-fade between adjacent music segments that are non-contiguous in the source music. One skilled in the art can see how the exemplary scenario can be extended to build additional music segments to correspond with additional video events.

Figure 9:
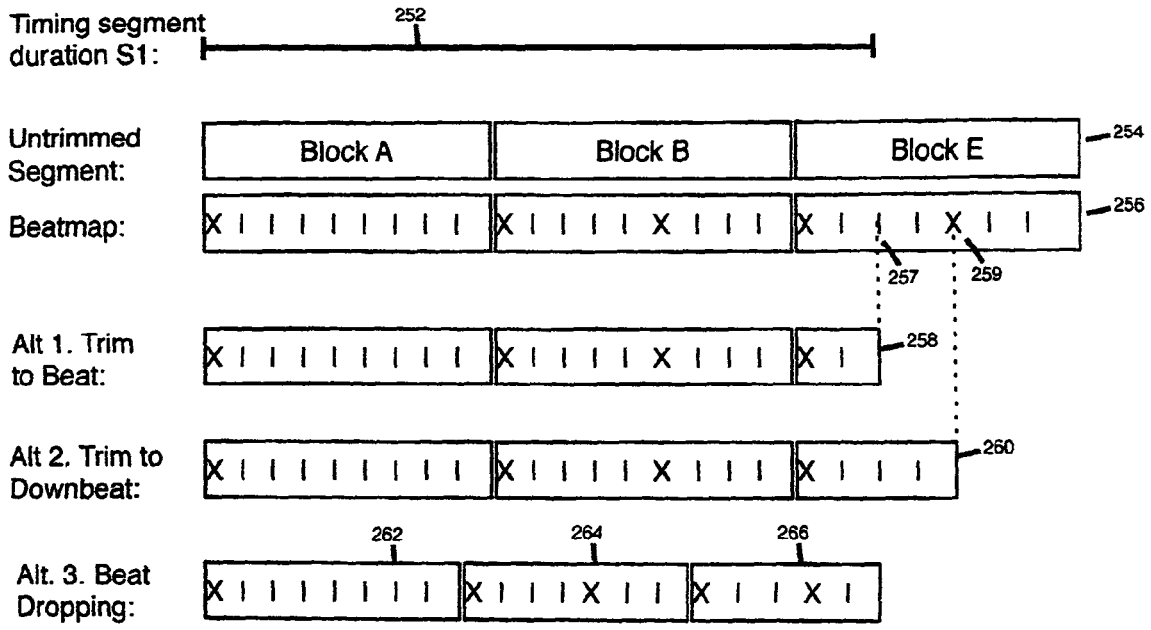
FIG. 9 is a chart depicting the state of an exemplary music segment prior to and following a segment trimming operation.

Attention is now directed to FIG. 9 showing how segment trimming can be performed on the exemplary untrimmed music segment 204 in FIG. 8. The untrimmed music segment 254, composed of data blocks A, B, E in sequence, is depicted in FIG. 9 as a time based representation. As demonstrated in FIG. 6B, the block data is cross-referenced with the beatmap to compile a beatmap 256 for the untrimmed music segment 254. In this example, data block A spans 9 beats, data block B spans 9 beats, and data block E spans 7 beats. A '|' in the diagram indicates the location of a basic beat while an 'X' additionally identifies a particularly significant beat, e.g., a downbeat.

The line segment 252 displays the desired duration for the music segment as defined by timing segment S1. The segment trimmer will utilize various strategies to shorten the music segment to more closely adhere to the duration of S1. A user of the system will preferably be allowed to specify which strategy he/she prefers, or the timing controller may specify a strategy. FIG. 9 depicts three alternative trimming strategies although it should be obvious that additional trimming algorithms could also be employed.

Alternative 1: Using the target duration 252, the nearest occurrence of any beat 257 (depicted as an '|' in the figure) is located in the beatmap 256. The end of the music segment is shortened by trimming block E 258 to the beat occurring most closely to the desired timing segment end time.

Alternative 2: Using the target duration 252, the nearest occurrence of a downbeat 259 (depicted as an 'X' in the figure) is located in the beatmap. The end of the music segment will be shortened to the location of a downbeat 260.

Alternative 3: An algorithm is employed to systematically remove beats just prior to downbeats until the segment has been sufficiently shortened. In this example a total of 5 beats have been removed. From block A 262, a single beat is removed from the end, falling immediately prior to the initial downbeat of block B. In block B a single beat is removed prior to the downbeat that occurs in the middle of the block, and an additional beat is removed from the end of the block. Block E 266 similarly has two beats removed, one form the middle and one from the end.

Figure 10:
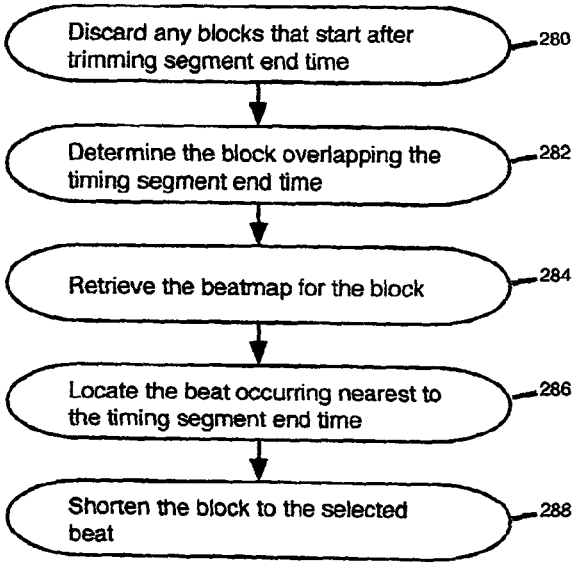
FIG. 10 is a flow chart depicting the operational sequence of the segment trimmer of FIG. 1B.

FIG. 10 is flow chart describing the operational sequence performed by the segment trimmer 76 of FIG. 3. More particularly, the system sequentially performs steps 280 through 288 to take an untrimmed music segment 254 and produce a trimmed music segment 258 in the manner represented in FIG. 9.

The foregoing describes a system operable by a user to produce an audio track synchronized to a video timing specification specifying successive timing segments. Although only a limited number of exemplary embodiments have been expressly described, it is recognized that many variations and modifications will readily occur to those skilled in the art which are consistent with the invention and which are intended to fall within the scope of the appended claims. One specific embodiment of the invention is included in the commercially available SmartSound Sonicfire Pro 5 product which contains a HELP file further explaining the operation and features of the system.

The invention claimed is:

1. A system for use with a video timing specification defining multiple video events where each such video event occurs at a unique timing point relative to a start time, said system being operable to produce an audio track including music events synchronized with said video events, said system comprising:

a music library comprising a plurality of music sources each having a plurality of defined length data blocks associated therewith;

a user controller operable to select a music source;

a timing controller responsive to said timing specification for identifying successive timing segments, each timing segment having a duration delimited by successive video events;

a music segment generator operable to produce an untrimmed music segment for each timing segment, each untrimmed music segment being comprised of a sequence of one or more data blocks selected from said selected music source; and a music segment trimmer operable to adjust the defined length of said untrimmed music segments to produce a plurality of final music segments each having a duration substantially equal to the duration of a corresponding timing segment; and wherein said timing controller operates to assemble said plurality of final music segments in an ordered sequence to define music events synchronized with said video events.

2. The system of claim 1 further including:

compatibility data associated with each data block defining its compatibility with other data blocks; and wherein said music segment generator is responsive to said compatibility data for producing said sequence of data blocks.

3. The system of claim 1 wherein said music segment trimmer adjusts the length of an untrimmed music segment by truncating at least one of the data blocks therein.

4. The system of claim 1 wherein said music source data blocks include beat data associated therewith defining a rhythmic sequence of beats; and wherein said music segment trimmer adjusts the end time defined by one or more of said untrimmed music segment data blocks to be substantially coincident with one of said beats.

5. The system of claim 4 wherein said sequence of beats includes basic beats and downbeats; and wherein said music segment trimmer adjusts the end time defined by at least one of said untrimmed music segment data blocks to be substantially coincident with one of said downbeats.

6. The system of claim 1 further including a video specification analyzer for identifying which of said plurality of music sources has a tempo closely related to the timing of said video events.

7. A method for generating an audio track to accompany a video track comprised of an ordered sequence of video events, said method comprising:

providing a plurality of music sources where each source includes multiple portions and a data block for each such portion specifying its duration;

identifying a sequence of discrete timing segments where each such timing segment is delimited by successive video events;

generating for each timing segment an untrimmed music segment comprised of an ordered sequence of one or more selected data blocks;

comparing the duration of the data block sequence for each untrimmed music segment with the duration of the associated timing segment;

processing each untrimmed music segment to produce a final music segment having a data block sequence defining a duration matching the duration of its associated timing segment; and assembling a plurality of final music segments in an ordered sequence to produce said audio track of successive music events synchronized to said successive video events.

8. The method of claim 7 wherein the data for each block further specifies interbiock compatibility; and wherein said step of generating an untrimmed music segment includes assuring compatibility between adjacent blocks in said ordered sequence of data blocks.

9. The method of claim 7 including the further step of providing beat data for each music source portion specifying a rhythmic sequence of beats; and wherein said step of processing untrimmed music segments includes trimming one or more of the data blocks in each untrimmed music segment to a duration substantially coincident with one of said beats.

10. The method of claim 7 including the further step of providing beat data for each music source portion specifying a rhythmic sequence of basic beats and downbeats; and wherein said step of processing untrimmed music segments includes adjusting the end time of at least one of said untrimmed music segment data blocks to be substantially coincident with one of said downbeats.

11. The method of claim 7 including the further step of analyzing said sequence of video events of identify preferred music sources from said plurality of music sounds.

* * * * *